US007748823B2

(12) United States Patent
Hung

(10) Patent No.: US 7,748,823 B2
(45) Date of Patent: Jul. 6, 2010

(54) INKJET DEVICE AND INKJET MAINTENANCE DEVICE THEREOF

(75) Inventor: Tsung-Chi Hung, Taipei County (TW)

(73) Assignee: Qisda Corporation, Taoyuan County (TW)

( * ) Notice: Subject to any disclaimer, the term of this patent is extended or adjusted under 35 U.S.C. 154(b) by 393 days.

(21) Appl. No.: 11/957,474

(22) Filed: Dec. 16, 2007

(65) Prior Publication Data

US 2008/0158293 A1 Jul. 3, 2008

(30) Foreign Application Priority Data

Jan. 2, 2007 (TW) ..... 96100118 A

(51) Int. Cl.
*B41J 2/165* (2006.01)

(52) U.S. Cl. ..... 347/33

(58) Field of Classification Search ..... 347/32, 347/33

See application file for complete search history.

(56) References Cited

U.S. PATENT DOCUMENTS 5,997,128 A * 12/1999 Lou et al. ..... 347/33
6,416,161 B1 7/2002 Berg et al.
6,601,943 B2 8/2003 Barinaga
7,175,253 B2 * 2/2007 Lee et al. ..... 347/32

* cited by examiner

*Primary Examiner*—Matthew Luu
*Assistant Examiner*—Alejandro Valencia

(57) ABSTRACT

The inkjet maintenance device cleans a printhead with a wiper on a first platform and cleans the wiper with a scraper on a second platform. Two slits with different shapes disposed on a base of the maintenance device allow the first platform and the second platform to slide respectively. In a single stroke of maintenance, the first platform and the second platform are simultaneously pushed substantially horizontally while the first platform further moves substantially vertically relative to the second platform, which allows the scraper on the second platform to clean the wiper of the first platform in the same stroke when the wiper cleans the printhead.

20 Claims, 16 Drawing Sheets

INKJET DEVICE AND INKJET MAINTENANCE DEVICE THEREOF

BACKGROUND OF THE INVENTION

1. Field of the Invention

The present invention relates to an inkjet device and an inkjet maintenance device thereof, and more specifically, to an inkjet device and an inkjet maintenance device having a scraper capable of cleaning a wiper.

2. Description of the Prior Art

Inkjet maintenance devices in a business machine are mainly for cleaning residual ink of the printheads by using a wiper for preventing the residual ink on the printheads from affecting the quality of printing or the function of the printhead. However, the wiped residual ink may cumulate on the wiper that deteriorates the function of the wiper for not being able to clean the printhead well and even worse, adding dirt to the printhead. The wiper can be cleaned by a scrape according to the prior art, which has two ways of practice: cleaning the wiper in a parallel but opposite direction or cleaning the wiper from the side of the wiper and moves perpendicular to the movement of the wiper.

Please refer to FIG. 1, which is an illustration of a first exemplary embodiment of the wiper and scrape of an inkjet maintenance device according to the U.S. Pat. No. 6,416,161. The wiper moves in parallel, opposite way to the stationary scrape, in other word, moves left and right driven by a gear assembly. FIG. 2 is an illustration of a second exemplary embodiment of the wiper and scrape of an inkjet maintenance device according to the U.S. Pat. No. 6,601,943. In this exemplary embodiment, the wiper is stationary and the scrape moves left and right driven by the gear assembly.

Please refer to FIG. 3 and FIG. 4, which are illustrations of a third exemplary embodiment of the wiper and scrape of an inkjet maintenance device according to the prior art. When the scrape is not cleaning the wiper, the scrape lies outside the wiper as in FIG. 3. The scrape moves from one side of the wiper to the other side as in FIG. 4 and during the movement, a sponge or a scraper on the scrape cleans the wiper by moving away ink on the wiper.

SUMMARY OF THE INVENTION

The present invention provides an inkjet maintenance device. The inkjet maintenance device comprises a base having a first slit and a second slit; a first platform comprising a first sliding pin and a slot, the first sliding pin extending through the first slit of the base, the first platform sliding relative to the base along the first slit; a wiper disposed on the first platform for cleaning the residual ink of a printhead on a cartridge, the wiper being adjacent to the slot of the first platform; a second platform comprising a second sliding pin extending through the second slit of the base, the second platform sliding relative to the base along the second slit; and a scraper disposed on the second platform and extending through the slot of the first platform for scraping the residual ink of the wiper when the first platform and the second platform have relative movement.

The present invention also provides an inkjet device. The inkjet device comprises a housing, a cartridge, and an inkjet maintenance device. The cartridge has a printhead and is installed on the housing. The inkjet maintenance device comprises a base having a first slit and a second slit; a first platform comprising a first sliding pin and a slot, the first sliding pin extending through the first slit of the base, the first platform sliding relative to the base along the first slit; a wiper is disposed on the first platform for cleaning the residual ink of the printhead when the printhead moves relative to the base, the wiper being adjacent to the slot of the first platform; a second platform comprises a second sliding pin extending through the second slit of the base, the second platform sliding relative to the base along the second slit; and a scraper is disposed on the second platform and extending through the slot of the first platform for scraping the residual ink of the wiper when the first platform and the second platform have relative movement.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
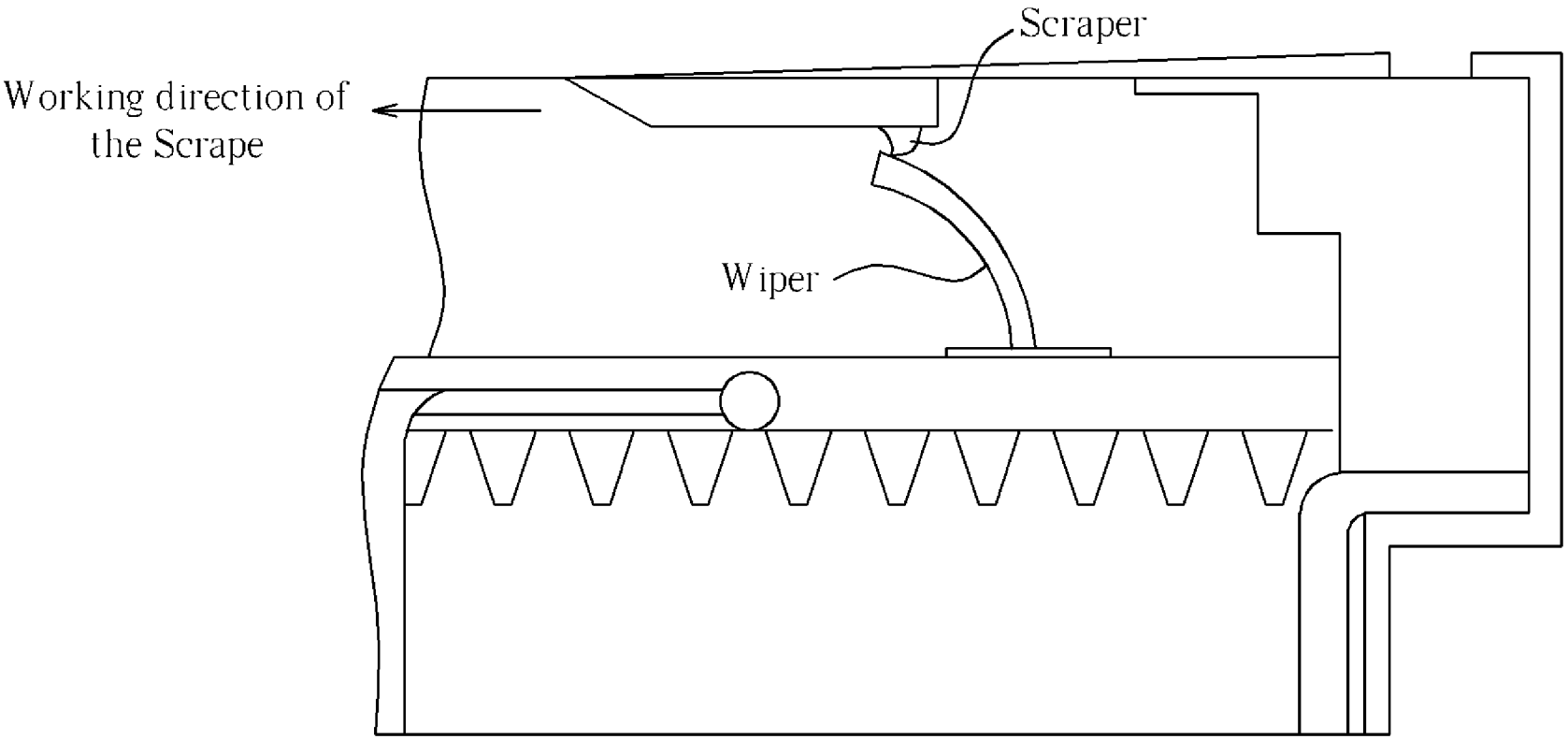
Fig. 1 Prior Art
FIG. 1 is an illustration of a first exemplary embodiment of the wiper and scrape of an inkjet maintenance device according to the prior art.
Figure 2:
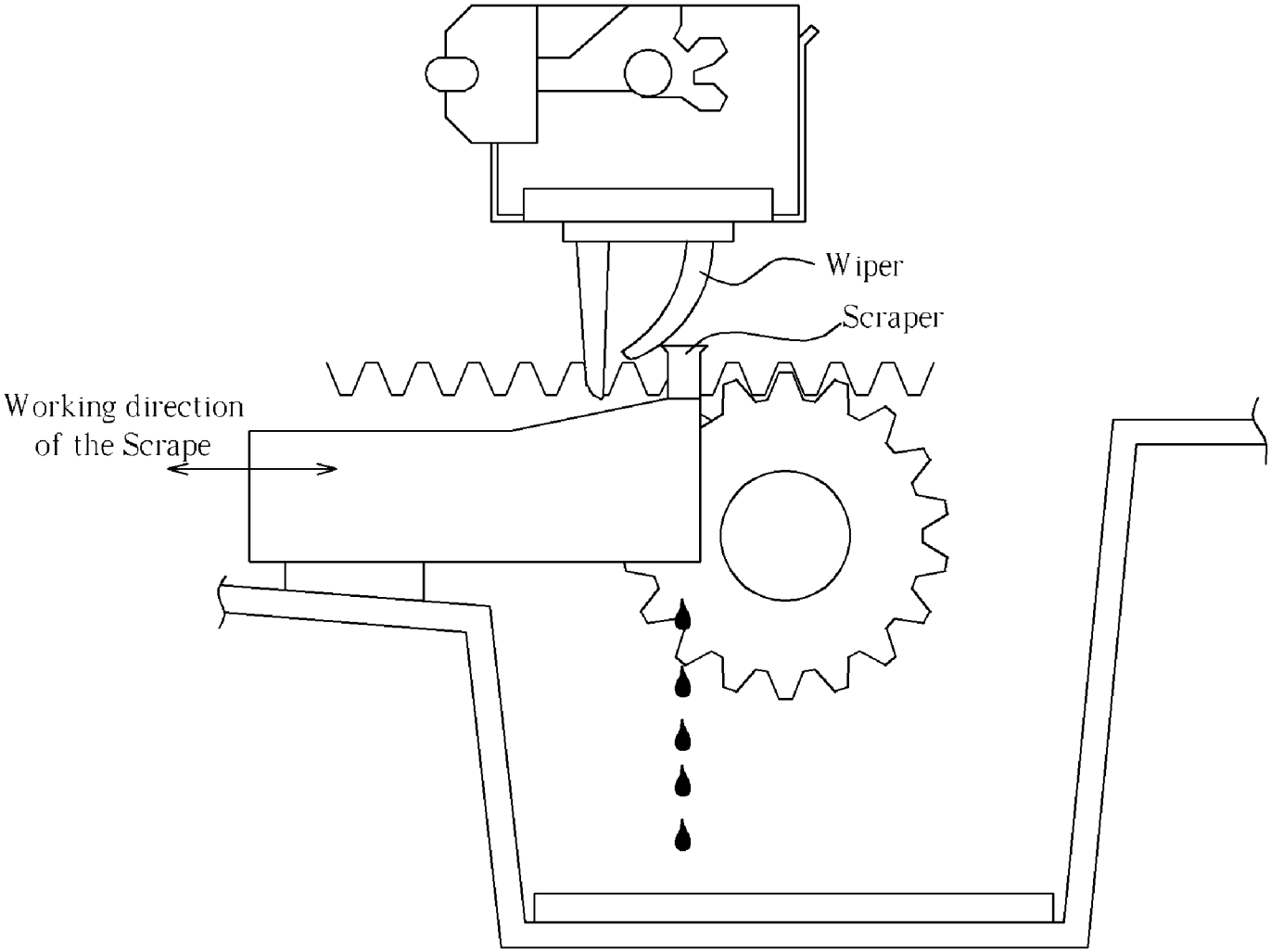
Fig. 2 Prior Art
FIG. 2 is an illustration of a second exemplary embodiment of the wiper and scrape of an inkjet maintenance device according to the prior art.
Figure 3:
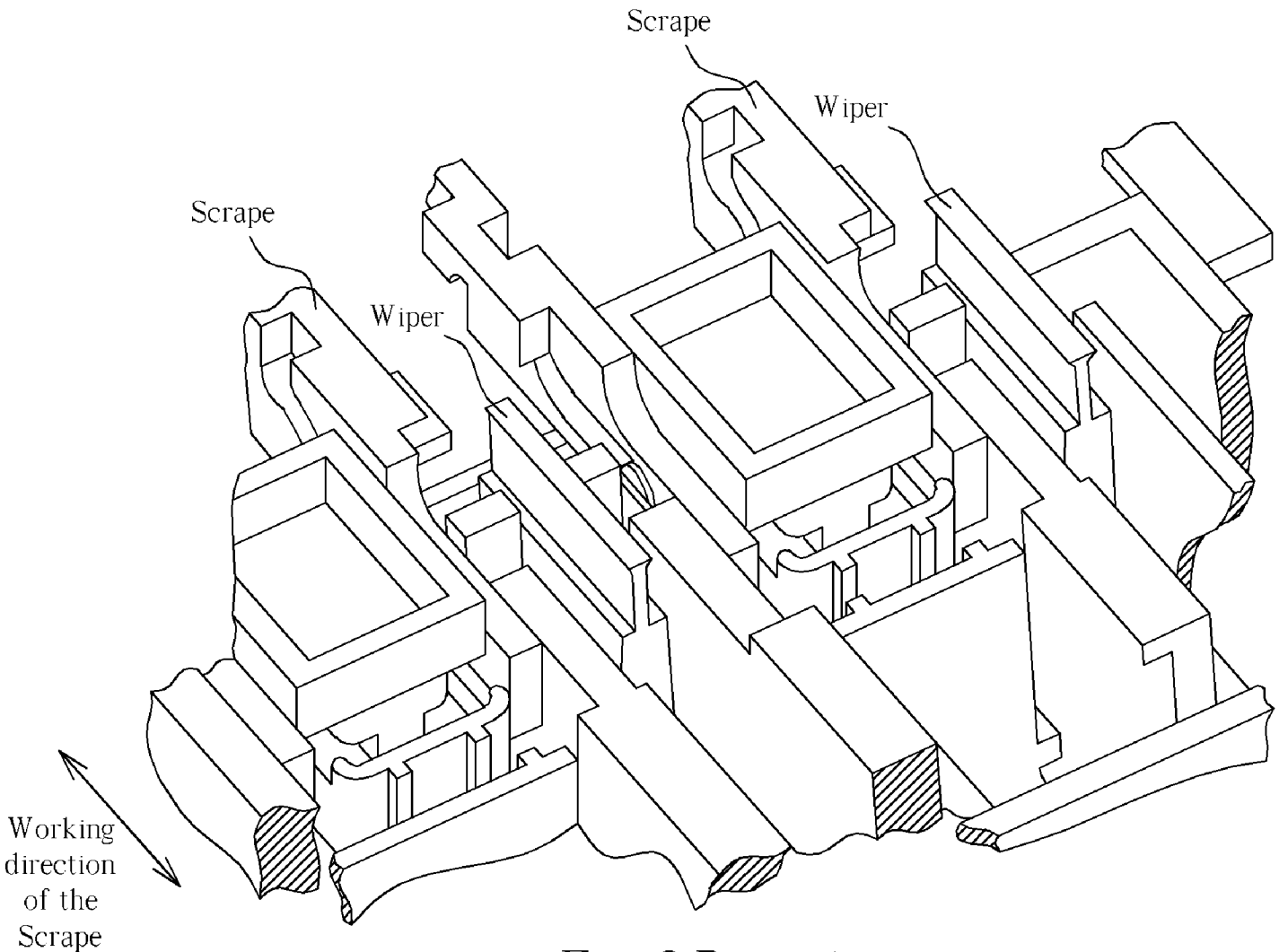
Fig. 3 Prior Art
FIG. 3 and FIG. 4 are illustrations of a third exemplary embodiment of the wiper and scrape of an inkjet maintenance device according to the prior art.
Figure 4:
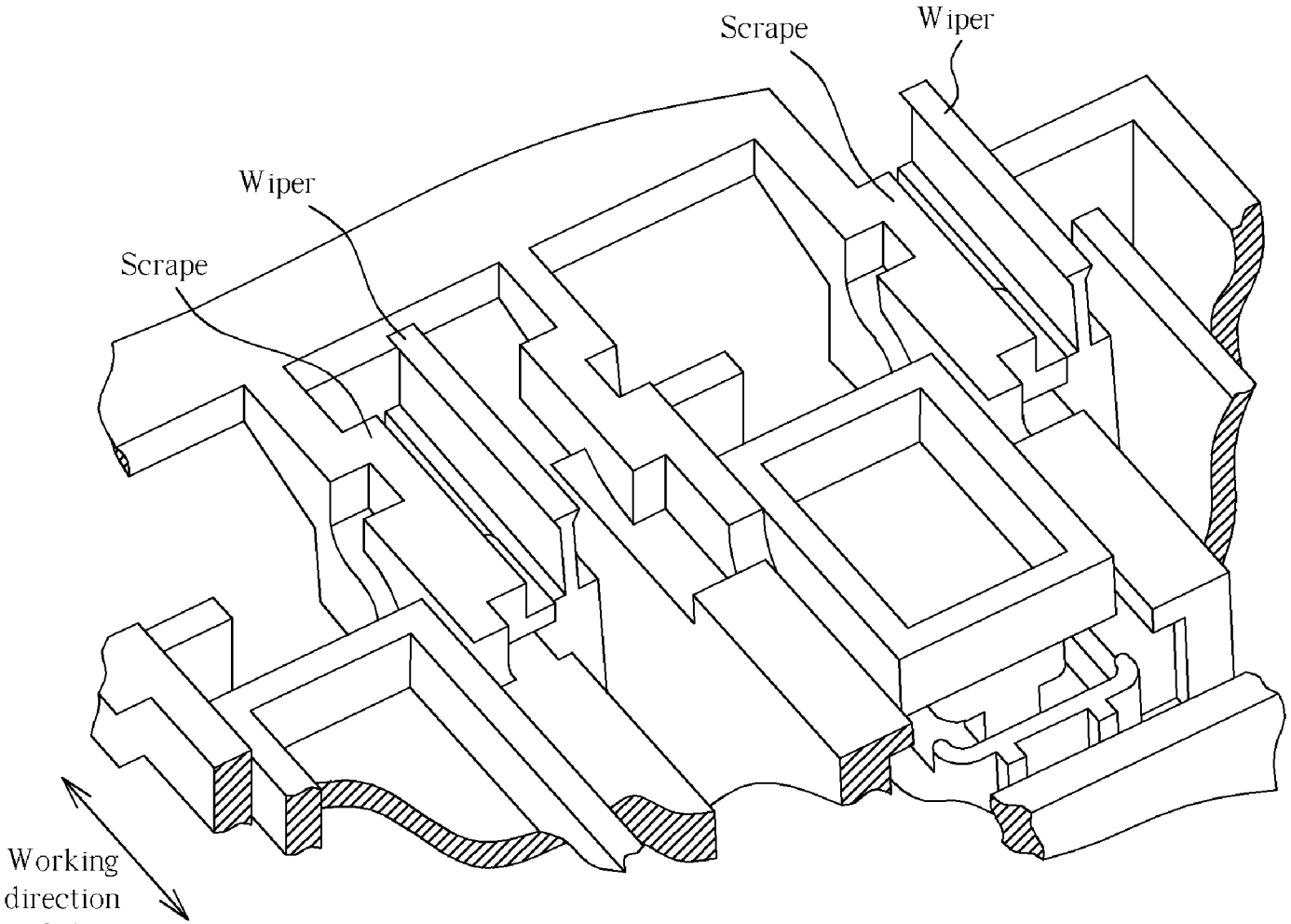
Fig. 4 Prior Art
Figure 5:
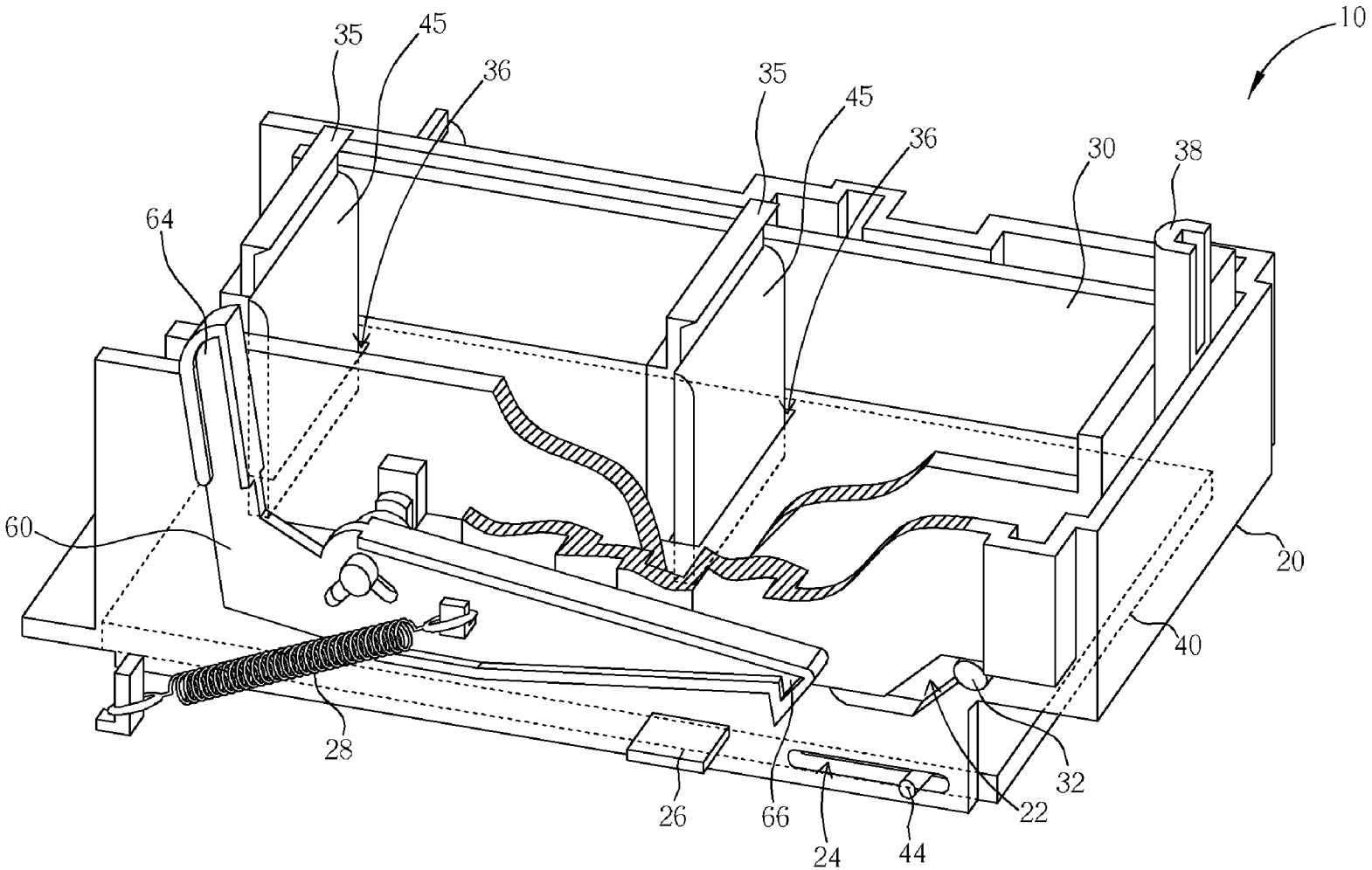
FIG. 5 is an illustration of an inkjet maintenance device having a scraper capable of vertically cleaning a wiper according to the present invention.

Please refer to FIG. 5, which is an illustration of the inkjet maintenance device 10 capable of cleaning a wiper according to the present invention and in the exemplary embodiment, the wiper is cleaned during a vertical movement. The inkjet maintenance device 10 comprises a base 20, a first platform 30, and a second platform 40. The base 20 has a first slit 22 and a second slit 24 where in the exemplary embodiment the first slit 22 has a slantwise ladder shape and the second slit 24 has a straight shape. Practically, the first slit 22 and the second slit 24 can be of any shapes as long as the first platform 30 and the second platform 40 have the same relative movement as disclosed in the exemplary embodiment due to the shapes of the first slit 22 and the second slit 24.

The inkjet maintenance device 10 further comprises a lever 60 installed on the first platform 30 capable of rotating about an axis. The lever 60 comprises a hook 66 and a second protrusion 64 where the hook 66 can engage with a projection 26 on the base 20. An elastic element 28, which can be a spring, connects between the lever 60 and the base 20. With the presence of relative movement between the first platform 30 and the second platform 40, the present invention uses the scraper for cleaning the residual ink on the wiper.

The first platform 30 holds a wiper 35 and has a first sliding pin 32 extending from the side of the first platform 30 through the first slit 22 of the base 20. When the first sliding pin 32 slides relative to the base 20 along the first slit 22, the slantwise ladder shape of the first slit 22 makes the first platform 30 move vertically and horizontally relative to the base 20. The wiper 35 on the first platform 30 is for cleaning a printhead (for more than one printhead in the printer, each printhead is cleaned by an individual wiper 35 which means more than one wiper 35 are disposed on the first platform 30) and is composed of rubber elastically deformable with force. When the printhead and the wiper 35 have interferential contact, the wiper 35 wipes away the residual ink on the printhead and cleans the printhead.

The second platform 40 holds a scraper 45 and has a second sliding pin 44 extending from the side of the second platform 40 through the second slit 24 of the base 20. When the second sliding pin 44 slides relative to the base 20 along the second slit 24, since the second slit 24 is substantially horizontal straight, the second platform 40 moves relative to the base 20 in a substantially horizontal direction. The scraper 45 is disposed on the second platform 40 for cleaning the wiper 35 (for more than one wiper 35 in the first platform 30, each wiper 45 is cleaned by an individual scraper 45 which means more than one scraper 45 are disposed on the second platform 40).

Figure 6:
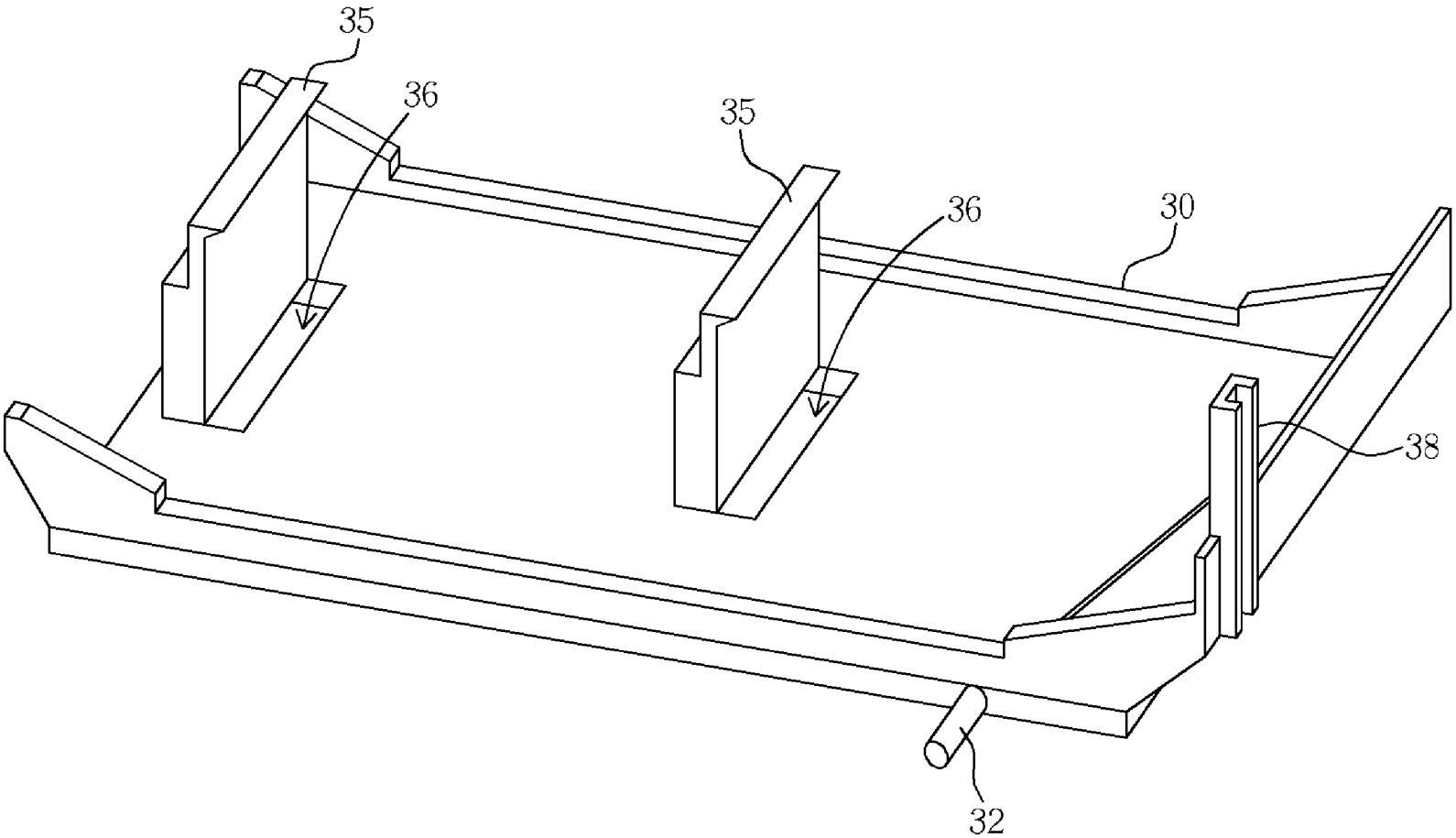
FIG. 6 is an illustration of the first platform of the inkjet maintenance device.
Figure 7:
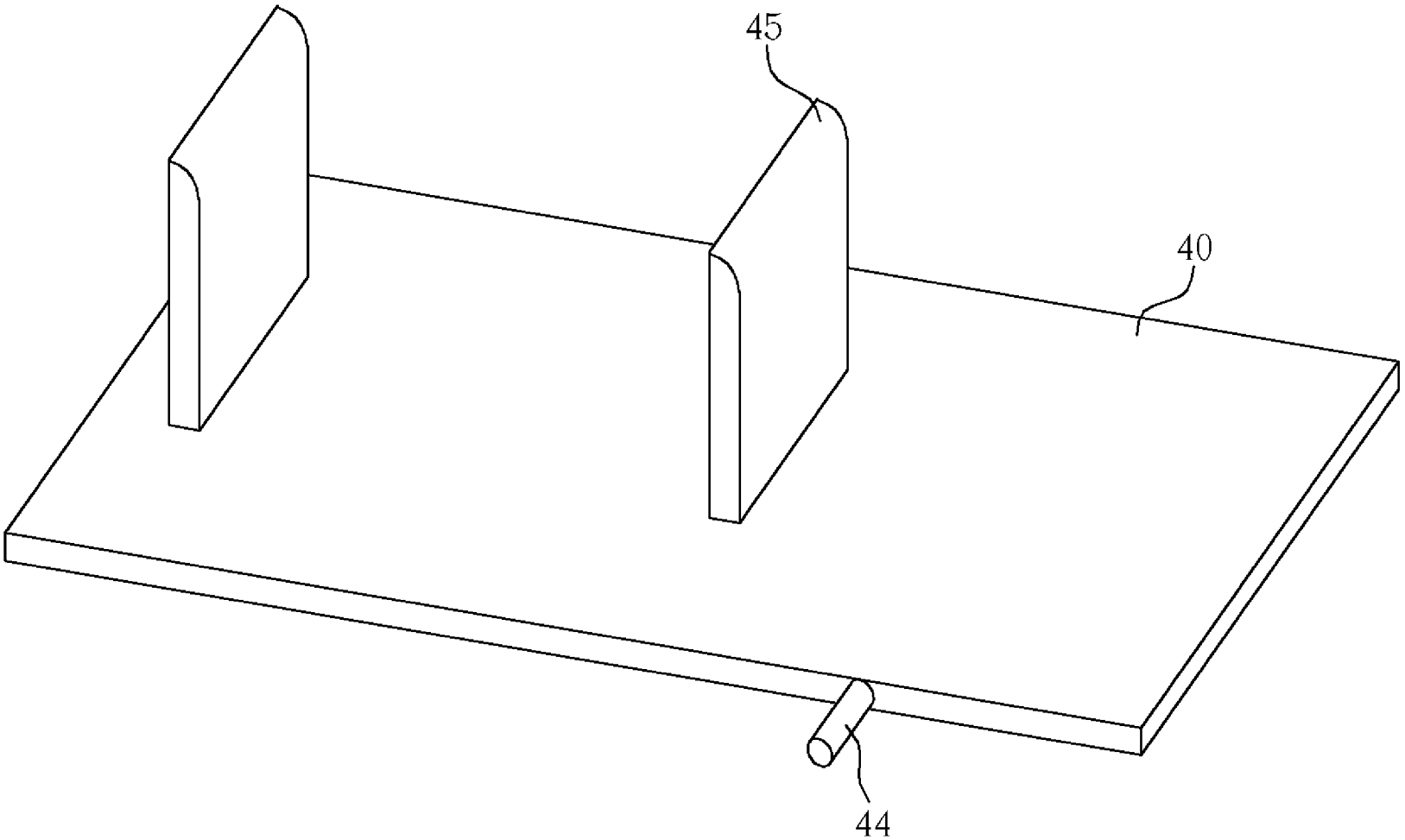
FIG. 7 is an illustration of the second platform of the inkjet maintenance device.

Please refer to FIG. 6 and FIG. 7. FIG. 6 is an illustration of the first platform 30 and FIG. 7 is an illustration of the second platform 40. The first platform 30 is disposed over the second platform 40 in the inkjet maintenance device 10 (or under the second platform 40 which requires corresponding slot in the second platform 40) and a slot 36 is disposed adjacent to the wiper 35 on the first platform 30 for providing room for the scraper 45 on the second platform 40 underneath to extend through. When the scraper 45 extends through the slot 36, the scraper 45 contacts closely to the wiper 35 for when the first platform 30 has substantially relative vertical movement with the second platform 40, the scraper 45 on the second platform 40 also has relative substantially vertical movement with the wiper 35 and therefore cleans the residual ink on the wiper 35.

Figure 8:
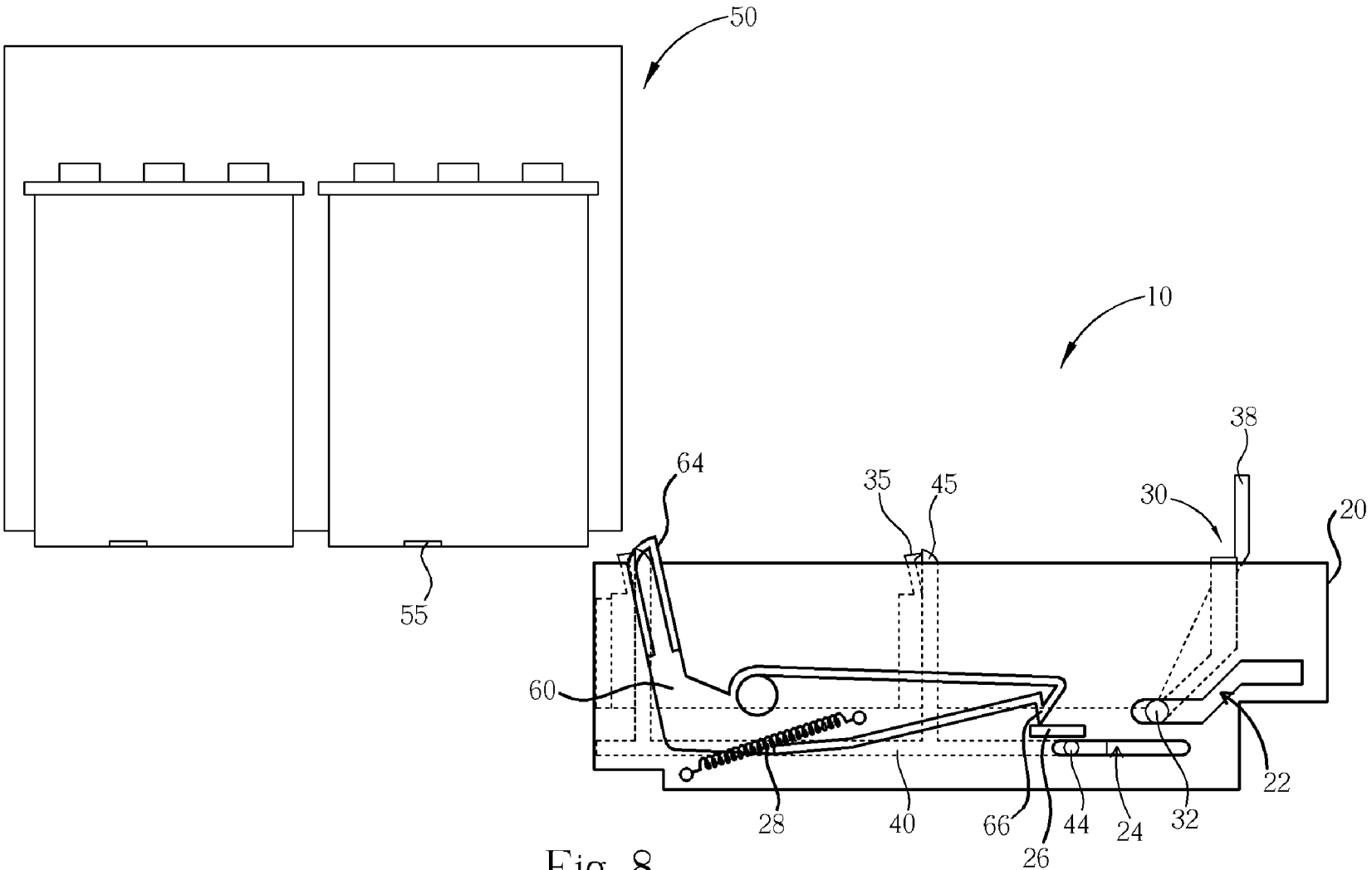
FIG. 8 to FIG. 12 are illustrations of continuous movements when the inkjet maintenance device In FIG. 5 cleans the printhead and the wiper.
Figure 15:
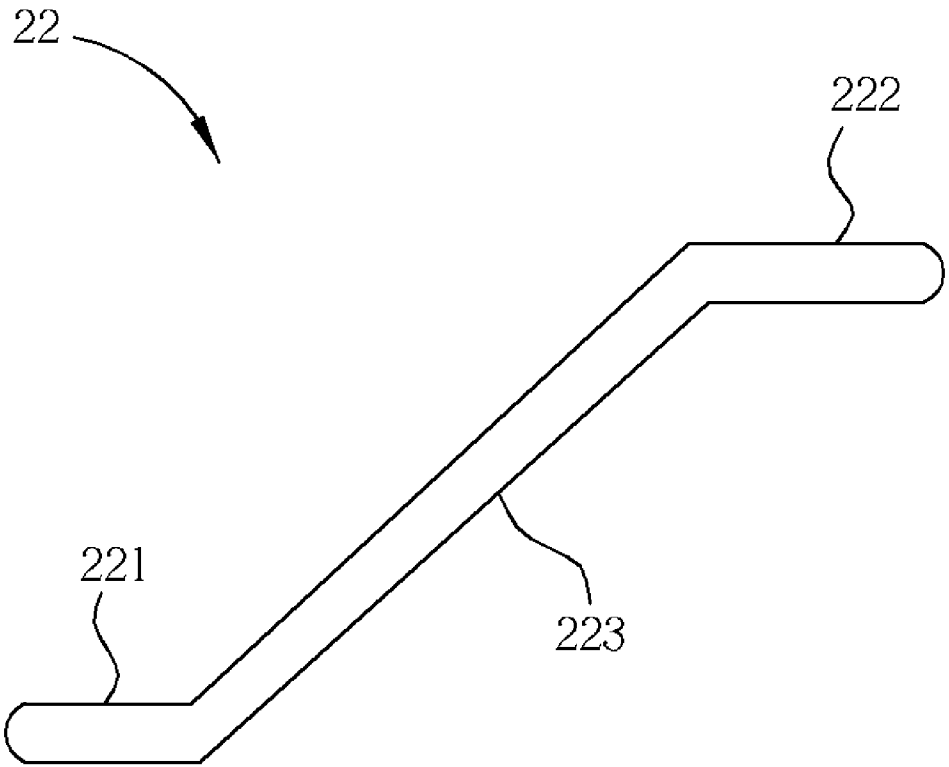
FIG. 15 is an illustration of three sections of the first slit.

Please refer to FIG. 8 to FIG. 12 and FIG. 15. FIG. 8 to FIG. 12 are illustrations of continuous movements when the inkjet maintenance device 10 cleans the printhead 55 and the wiper 35. FIG. 15 is an illustration of three sections 221, 222, 223 of the first slit 22 where the second section 22 lies closer to the printhead 55 than the first section and the third section 223 forms between the first section 221 and the second section 222. In FIG. 8, when the cartridge 50 as well as the printhead 55 position outside the inkjet maintenance device 10, the first platform 30 and the second platform 40 of the inkjet maintenance device 10 are in a "first status" with which the first sliding pin 32 of the first platform 30 lies at the bottom of the first slit 22, i.e. the first section 221. In other words, the first platform 30 lies at a lowest position. In the first status, the tip of the scraper 45 of the second platform 40 is higher than the adjacent wiper 35 and interferes with the wiper 35 that is slightly pushed and deforms because of the scraper 45.

Figure 9:
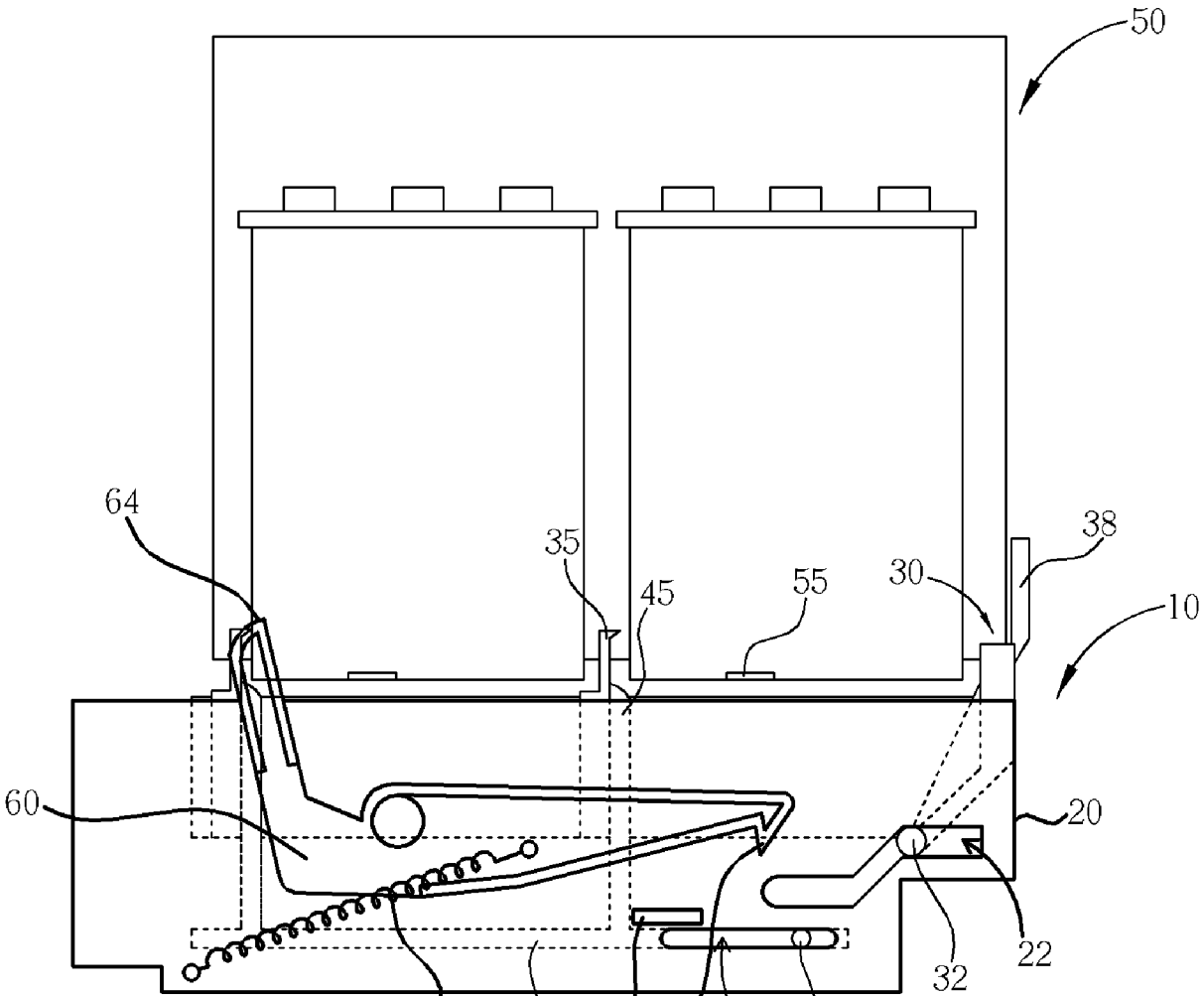

In FIG. 9, when the cartridge 50 moves to the right and enters the inkjet maintenance device 10, it pushes a first protrusion 38 of the first platform 30 and brings the first platform 30 to move to the right. Since the first sliding pin 32 of the first platform 30 is restricted in the movement by the shape of the first slit 22, the first platform 30 moves substantially horizontally (to the right) and vertically (upward) relative to the base 20 and finally the first sliding pin 32 reaches to the top of the first slit 22, i.e. the second section 222. In other words, the first platform 30 lies at a highest position. When the cartridge 50 pushes the first platform 30, the first platform 30 also moves the scraper 45 and the second platform 40 which the scraper 45 is disposed on since the scraper 45 of the second platform 40 extends through the slot 36 of the first platform 30. The movement of the second platform 40 is restricted by the substantially horizontal shape of the second slit 24 of the base 20 as the second sliding pin 44 slides along the second slit 24 and therefore when the first platform 30 moves the second platform 40, the second platform 40 moves substantially horizontally to the right. The vertical movement of the first platform 30 has no effect on the movement of the second platform 40. In such way, the first platform 30 can be viewed as having mere vertical relative movement with the second platform 40 when the cartridge 50 pushes the first platform 30 (and the second platform 40). As to the wiper 35 and the scraper 45 on the two platforms respectively, the wiper 35 moves upward relative to the scraper 45 and ends up being higher than the scraper 45 where the scraper 45 no longer interferes with the wiper 35. This is a "second status" of the first platform 30 and the second platform 40 as shown in FIG. 9. In the second status, the lever 60 installed on the first platform 30 moves with the first platform 30 and the elastic element 28 connecting between the lever 60 and the base 20 is stretched that causes the lever 60 to slightly rotate about the first platform 30 and the hook 66 of the lever 60 is lifted.

Figure 10:
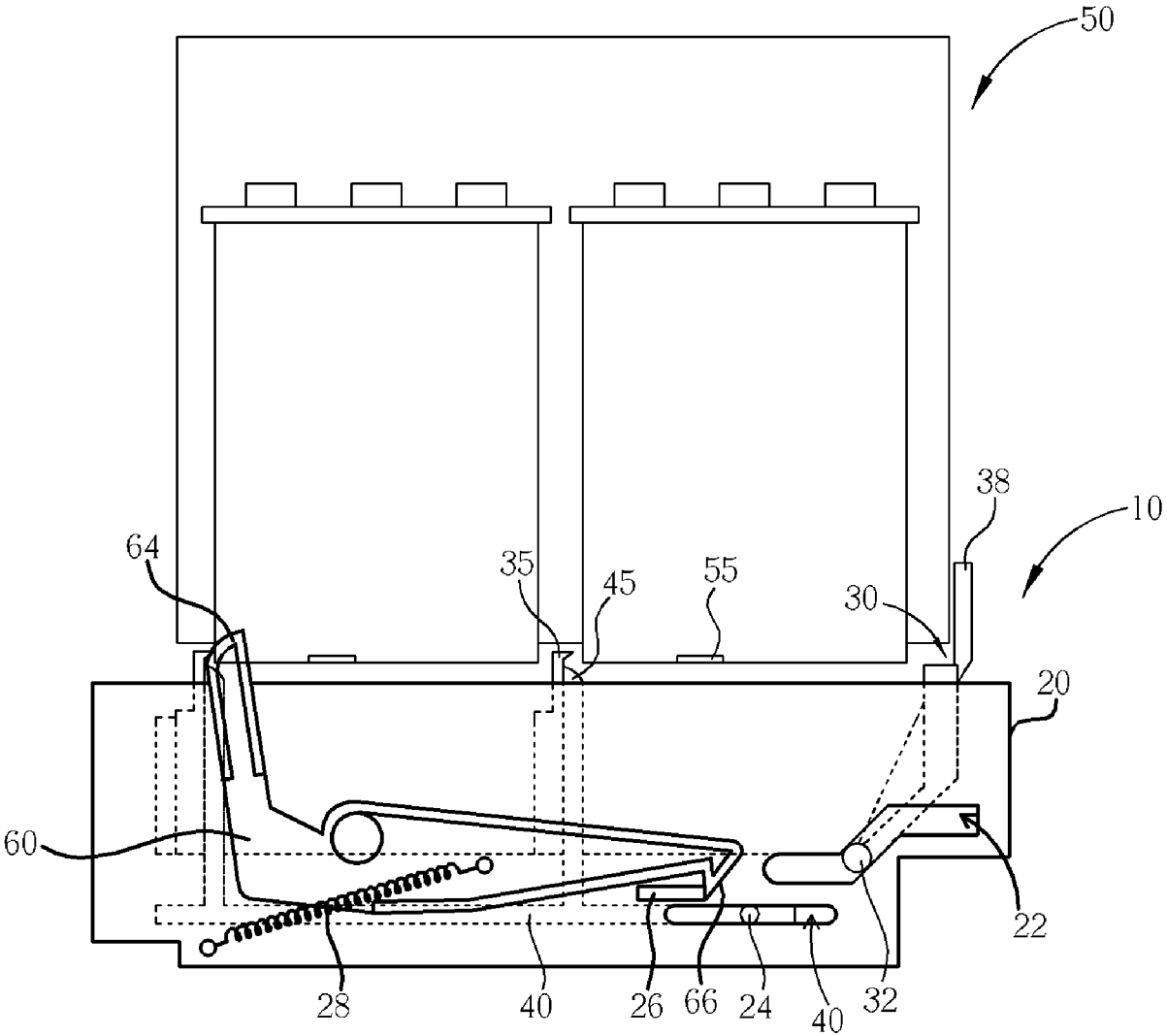

In FIG. 10, once the cartridge 50 moves to left and stop pushing the first protrusion 38 of the first platform 30, the elastic element 28 connecting between the lever 60 and the base 20 pulls the lever 60 as well as the first platform 30 to move to the left. The first platform 30 moves the second platform 40 to the left as well and has substantially relative vertical (downward) movement with the second platform 40. The lifted hook 66 in FIG. 9 engages with a projection 26 of the base 20 when the lever 60 is pulled by the elastic element 28 and rotates which keeps the first platform 30 from further being pulled by the elastic element 28. As FIG. 10 shows, the first sliding pin 32 of the first platform 30 lies in the middle height position of the first slit 22, i.e. the third section 223 and the wiper 35 of the first platform 30 is slightly lower than the height of the wiper 35 in the second status. In FIG. 10, the first platform 30 and the second platform 40 are in a "third status" and the scraper 45 of the second platform 40 is contacting the wiper 35 but not interfering with the wiper 35.

Figure 11:
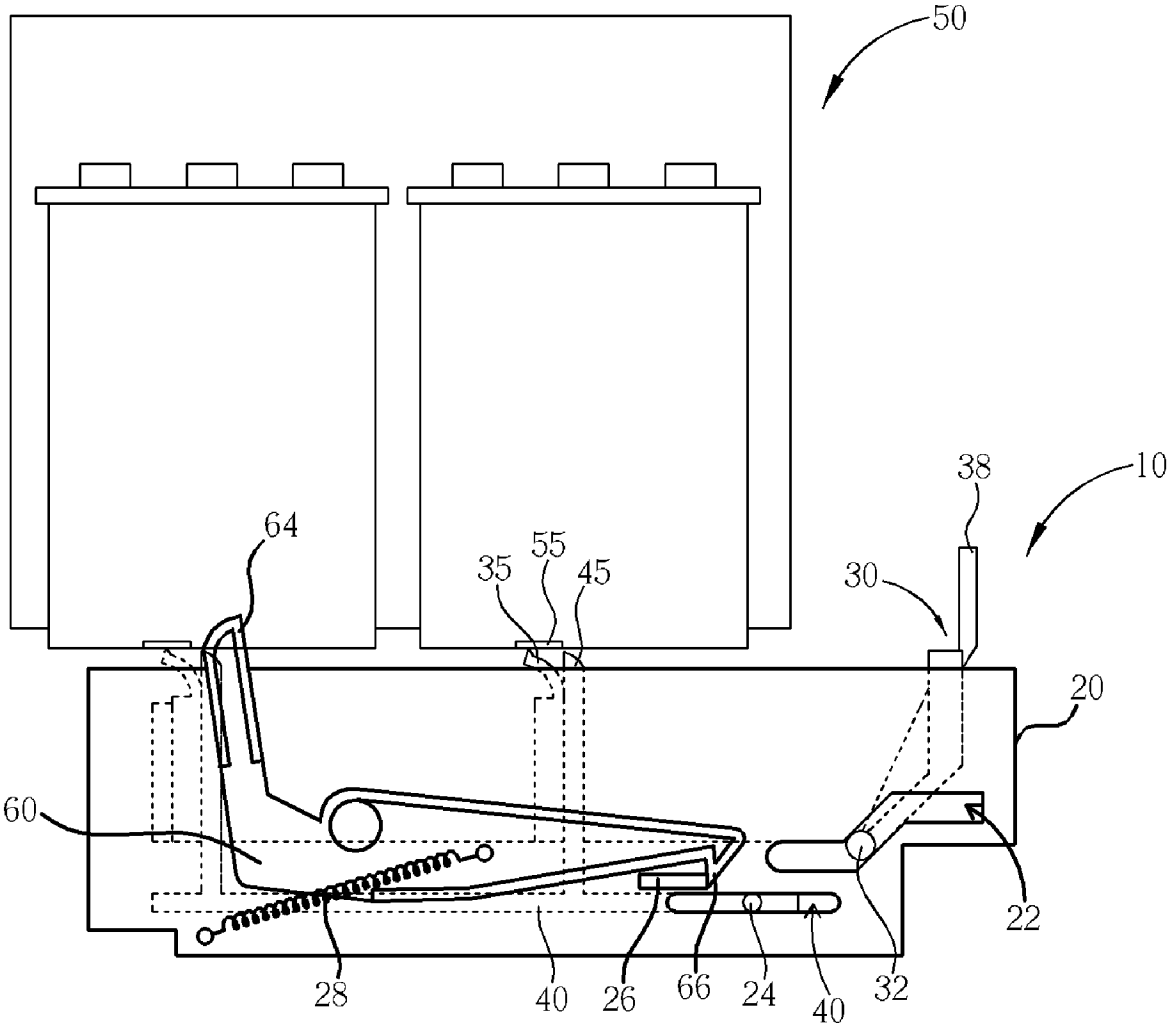
Figure 12:
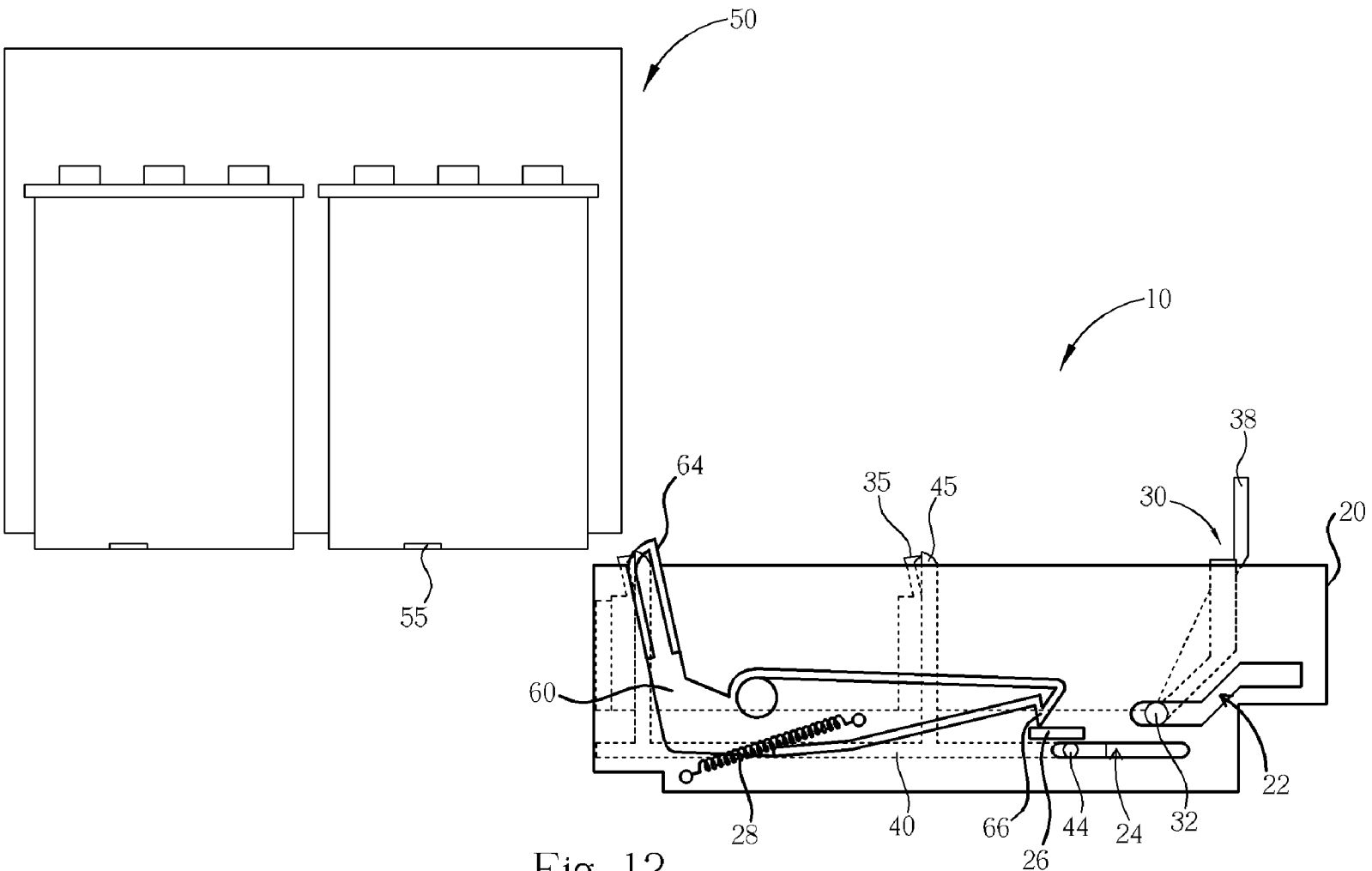

Please refer to FIG. 11. In the third status, the cartridge 50 keeps moving to the left and since the wiper 35 is slightly higher than the printhead 55 of the cartridge 50, the cartridge 50 and the printhead 55 have interference with the wiper 35 and deform the wiper 45 when passing through the wiper 35. The deformed wiper 35 then cleans the residual ink on the printhead 55.

When the cartridge 50 keeps moving to the left and the printhead 55 is cleaned by the wiper 35, a pin of the cartridge 50 (not shown in the figure) pushes a second protrusion 64 of the lever 60 and slightly rotates the lever 60, which lifts the hook 66, causing the hook 66 to disengage from the projection 26 and the elastic element 28 is capable of pulling the lever 60 back to the left. The first platform 30 as well as the second platform 40 are also pulled by the elastic element 28 and return to the first status as in FIG. 8. When the first platform 30 and the second platform 40 move to the left from the third status to the first status, the first platform 30 is having substantially vertical (downward) relative movement with the second platform 40 that brings the wiper 35 to move downward relative to the scraper 45. The scraper 45 is having interference with the wiper 35 again and capable of cleaning the residual ink on the wiper 35. The inkjet maintenance device 10 according to the present invention goes back to the first status in FIG. 8 and finishes cleaning the printhead 55 and the wiper 35 in a single stroke.

Figure 13:
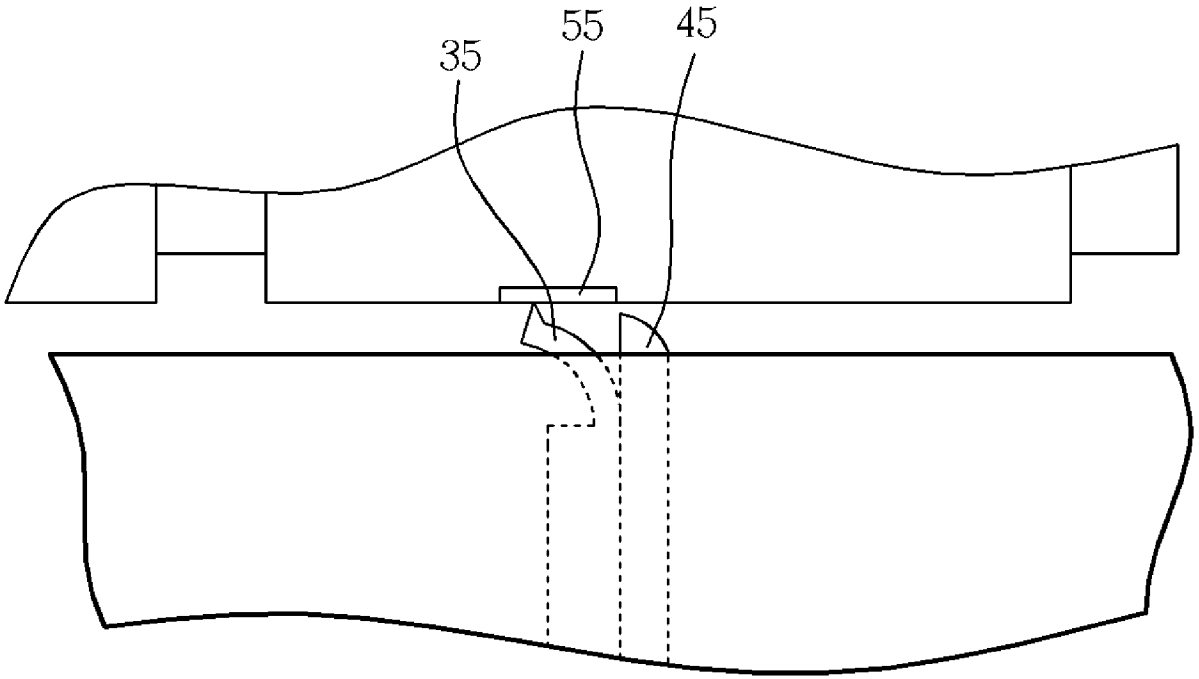
FIG. 13 and FIG. 14 are illustrations of the relative positions of the cartridge, the wiper, and the scraper.
Figure 14:
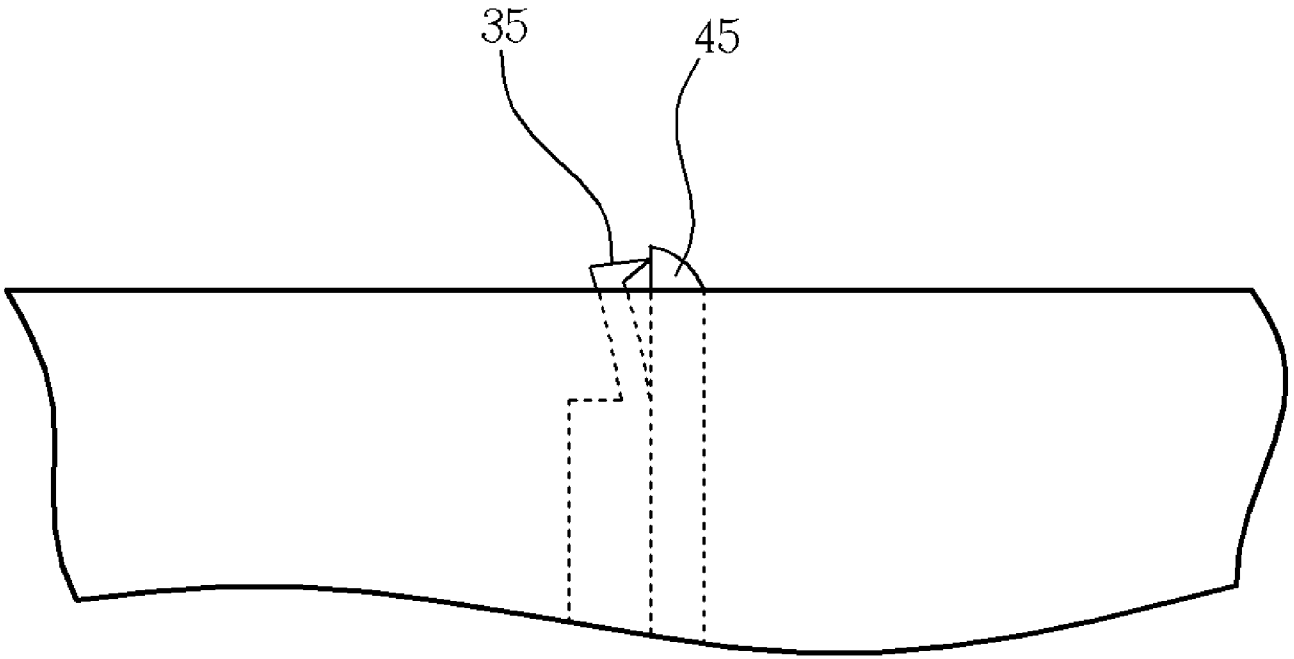

FIG. 13 and FIG. 14 are illustrations of the relative positions of the cartridge 50, the wiper 35, and the scraper 45 going from the third status to the first status. The deformed wiper 35 in FIG. 13 is capable of cleaning the residual ink on the printhead 55 and cleaning the wiper 35 with the scraper 45 is carried out from the third status in FIG. 13 to the first status in FIG. 14.

Figure 16:
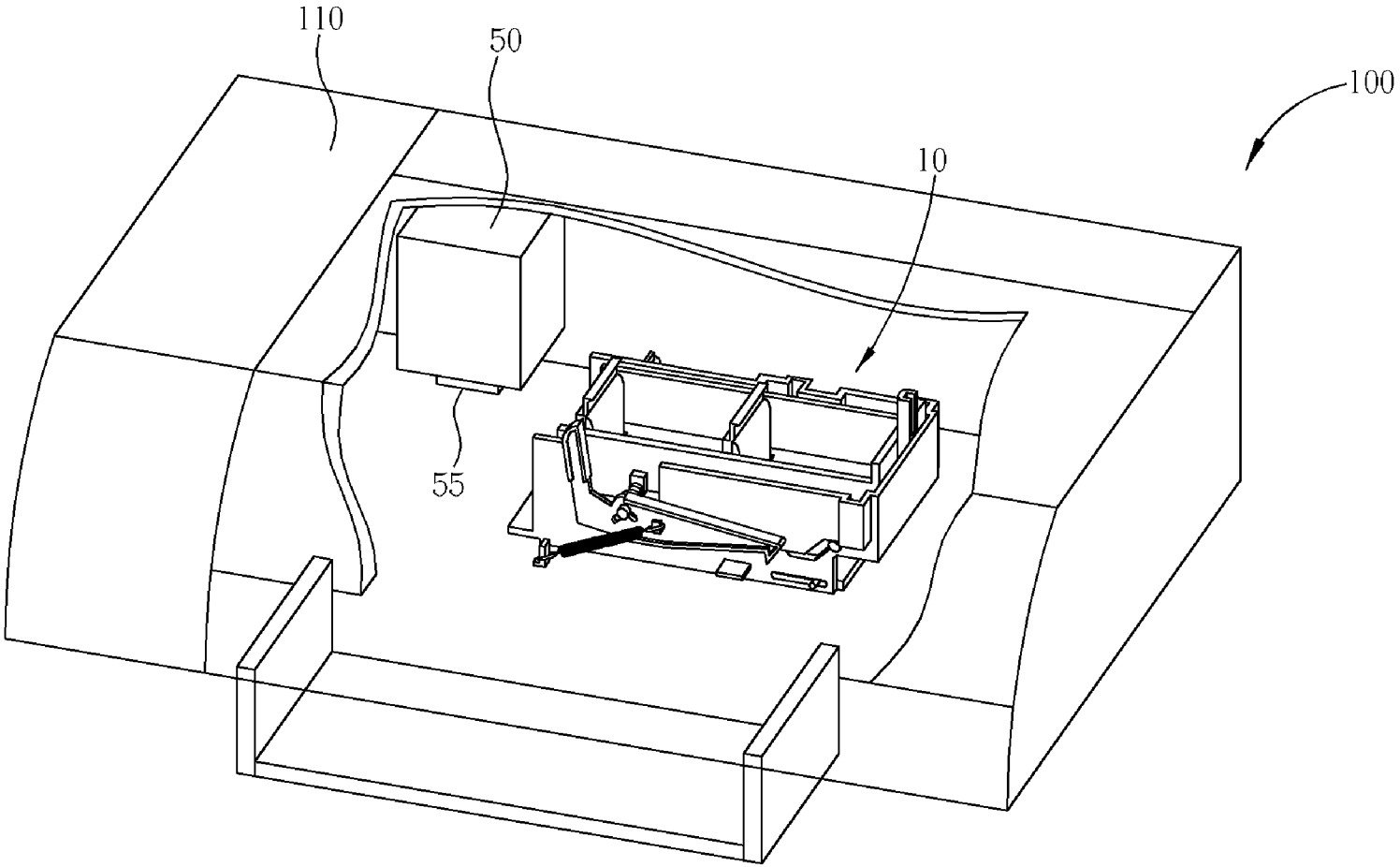
FIG. 16 is an illustration of the inkjet device.

Please refer to FIG. 16, which is an exemplary embodiment of an inkjet device 100 applying the inkjet maintenance device 10 according to the present invention. The printhead 55 is on the cartridge 50 disposed inside the housing 110 of the inkjet device 100 and the cartridge 50 is capable of printing when moving reciprocally along a direction inside the housing 110. The inkjet maintenance device 10 is disposed at one side of the housing 110. When the cartridge 50 brings the printhead 50 to the side of the housing 110, the inkjet maintenance device 10 carries out the aforementioned cleaning process on the printhead 55 and the wiper 35.

The inkjet maintenance device according to the present invention cleans the printhead with the wiper on the first platform and cleans the wiper with the scraper on the second platform. The two slits with different shapes disposed on the base of the maintenance device allow the first platform and the second platform to slide respectively. In a single stroke of maintenance, the first platform and the second platform are simultaneously pushed substantially horizontally while the first platform further moves substantially vertically relative to the second platform, which allows the scraper on the second platform to clean the wiper of the first platform in the same stroke when the wiper cleans the printhead.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An inkjet maintenance device, comprising:

a base having a first slit and a second slit;

a first platform comprising a first sliding pin and a slot, the first sliding pin extending through the first slit of the base, the first platform sliding relative to the base along the first slit;

a wiper disposed on the first platform for cleaning the residual ink of a printhead on a cartridge, the wiper being adjacent to the slot of the first platform;

a second platform comprising a second sliding pin extending through the second slit of the base, the second platform sliding relative to the base along the second slit; and a scraper disposed on the second platform and extending through the slot of the first platform for scraping the residual ink of the wiper when the first platform and the second platform have relative movement.

2. The inkjet maintenance device of claim 1 wherein the scraper is for scraping the residual ink of the wiper when the first platform substantially moves vertically relative to the second platform.

3. The inkjet maintenance device of claim 1 wherein the first platform further comprises a first protrusion for being pushed by the cartridge and making the first sliding pin slide along the first slit.

4. The inkjet maintenance device of claim 1 wherein the first platform is for moving the second platform, making the second sliding pin slide along the second slit when the first sliding pin slides along the first slit.

5. The inkjet maintenance device of claim 1 wherein the first slit has a slantwise ladder shape.

6. The inkjet maintenance device of claim 1 wherein the second slit has a straight shape and the second platform slides along the second slit in a substantially horizontal direction.

7. The inkjet maintenance device of claim 1 wherein the first slit has a first section and a second section, the second section locating closer to the printhead than the first section, the scraper being higher than the wiper when the first sliding pin lies at the first section, the wiper being higher than the scraper when the first sliding pin lies at the second section.

8. The inkjet maintenance device of claim 7, further comprising a lever rotatably installed on the first platform, the lever comprising a hook and a second protrusion.

9. The inkjet maintenance device of claim 8 wherein the base further comprises a projection, the first slit having a third section forming between the first section and the second section, the first sliding pin of the first platform lying at the third section and the wiper being higher than the printhead when the hook engages with the projection.

10. The inkjet maintenance device of claim 9 wherein when the first sliding pin slides from the third section to the first section, the scraper is for moving relative to the wiper and scraping the residual ink of the wiper.

11. The inkjet maintenance device of claim 1, further comprising a lever rotatably installed on the first platform, the lever comprising a hook and a second protrusion, the base further comprising a projection for engaging the hook, the hook disengaging from the projection when the cartridge pushes the second protrusion.

12. The inkjet maintenance device of claim 11, further comprising an elastic element connected between the lever and the base for moving the first platform, making the first sliding pin slide along the first slit.

13. An inkjet device, comprising:

a housing;

a cartridge having a printhead, the cartridge installed on the housing; and an inkjet maintenance device, comprising:

a base having a first slit and a second slit;

a first platform comprising a first sliding pin and a slot, the first sliding pin extending through the first slit of the base, the first platform sliding relative to the base along the first slit;

a wiper disposed on the first platform for cleaning the residual ink of the printhead when the printhead moves relative to the base, the wiper being adjacent to the slot of the first platform;

a second platform comprising a second sliding pin extending through the second slit of the base, the second platform sliding relative to the base along the second slit; and a scraper disposed on the second platform and extending through the slot of the first platform for scraping the residual ink of the wiper when the first platform and the second platform have relative movement.

14. The inkjet device of claim 13 wherein the scraper is for scraping the residual ink of the wiper when the first platform substantially moves vertically relative to the second platform.

15. The inkjet device of claim 13 wherein the first slit has a slantwise ladder shape.

16. The inkjet device of claim 13 wherein the second slit has a straight shape and the second platform slides along the second slit in a substantially horizontal direction.

17. The inkjet device of claim 13 wherein the first slit has a first section and a second section, the second section locating closer to the printhead than the first section, the scraper being higher than the wiper when the first sliding pin lies at the first section, the wiper being higher than the scraper when the first sliding pin lies at the second section.

18. The inkjet device of claim 17, further comprising a lever rotatably installed on the first platform, the lever comprising a hook and a second protrusion, the base further comprising a projection, the first slit having a third section forming between the first section and the second section, the first sliding pin of the first platform lying at the third section and the wiper being higher than the printhead when the hook engages with the projection.

19. The inkjet device of claim 18 wherein when the first sliding pin slides from the third section to the first section, the scraper is for moving relative to the wiper and scraping the residual ink of the wiper.

20. The inkjet device of claim 13, further comprising a lever and an elastic element, the lever rotatably installed on the first platform, the lever comprising a hook and a second protrusion, the base further comprising a projection for engaging the hook, the hook disengaging from the projection when the cartridge pushes the second protrusion, the elastic element connected between the lever and the base for moving the first platform, making the first sliding pin slide along the first slit.

* * * * *